US006106640A

United States Patent [19]

Liu

[11] Patent Number: 6,106,640

[45] Date of Patent: Aug. 22, 2000

[54] $NI_3AL$-BASED INTERMETALLIC ALLOYS HAVING IMPROVED STRENGTH ABOVE 850° C.

[75] Inventor: Chain T. Liu, Oak Ridge, Tenn.

[73] Assignee: Lockheed Martin Energy Research Corporation, Oak Ridge, Tenn.

[21] Appl. No.: 09/093,475

[22] Filed: Jun. 8, 1998

[51] Int. Cl.[7] ..... C22C 19/05

[52] U.S. Cl. ..... 148/428; 420/445

[58] Field of Search ..... 420/445; 148/410, 148/428

[56] References Cited

U.S. PATENT DOCUMENTS 5,006,308 4/1991 Liu et al. ..... 420/445

5,108,700 4/1992 Liu ..... 420/445

OTHER PUBLICATIONS

Y. F. Han et al, "Microstructural Stability of A DS $Ni_3Al$ Base Superalloy," Proceedings of the International Workshop, Ordered Intermetallics (IWO '92), Sep.–28–Oct. 1, 1992, pp. 356–362.

*Primary Examiner*—Deborah Yee
*Attorney, Agent, or Firm*—Joseph A. Marasco

[57] ABSTRACT

Intermetallic alloys composed essentially of: 15.5% to 17.0% Al, 3.5% to 5.5% Mo, 4% to 8% Cr, 0.04% to 0.2% Zr, 0.04% to 1.5% B, balance Ni, are characterized by melting points above 1200° C. and superior strengths at temperatures above 1000° C.

3 Claims, 3 Drawing Sheets

$NI_3AL$-BASED INTERMETALLIC ALLOYS HAVING IMPROVED STRENGTH ABOVE 850° C.

The United States Government has rights in this invention pursuant to contract no. DE-AC05-96OR22464 between the United States Department of Energy and Lockheed Martin Energy Research Corporation.

FIELD OF THE INVENTION

The present invention relates to $Ni_3Al$-based intermetallic alloys, and more particularly to such having improved strength above 850° C.

BACKGROUND OF THE INVENTION

U.S. Pat. No. 5,282,907 issued on Feb. 1, 1994 entitled "Cast Nickel Aluminide Alloys for Structural Application", incorporated herein by reference, describes castable $Ni_3Al$ alloys, e.g. IC-396 (Ni 16.4 Al—8 Cr—1.5 Mo—0.5 Zr—0.15 B, at. %), for structural use at elevated temperatures in hostile environments. Further study of the metallurgical and mechanical properties of those alloys described therein has indicated two disadvantages.

Firstly, although those alloys have proven to be characterized by excellent strength at temperatures up to 850° C., there is a sharp decrease in strength above 850° C.

The second drawback is that those alloys showed incipient melting points (IMP) between 1150–1200° C. This limits the useful temperature range of the alloys below 1150° C. Consequently, those alloys cannot be exposed to temperatures above 1150° C. for longer than several hours.

It is desirable to improve the strength of such alloys at high temperatures in order to achieve usefulness as a high-strength composition above 1000° C. It is known that the metals industry is in need of structural materials capable of tolerating temperatures as high as 1300° C. For example, many heat-treatment industries currently lack tray and fixture materials to be used at high temperatures.

OBJECTS OF THE INVENTION

Accordingly, objects of the present invention include new $Ni_3Al$ alloys which have characteristics as described in the above referenced U.S. Patent, and are further characterized by incipient melting points above 1200° C. and superior strengths at temperatures above 1000° C.

Further and other objects of the present invention will become apparent from the description contained herein.

SUMMARY OF THE INVENTION

In accordance with one aspect of the present invention, the foregoing and other objects are achieved by an intermetallic alloy composed essentially of: 15.5% to 17.0% Al, 3.5% to 5.5% Mo, 4% to 8% Cr, 0.04% to 0.2% Zr, 0.04% to 1.5% B, balance Ni.

In accordance with one aspect of the present invention, an intermetallic alloy is composed essentially of: 16.45% Al, 4% Mo, 6% Cr, 0.1% Zr, 0.15% B, balance Ni.

Figure 1:
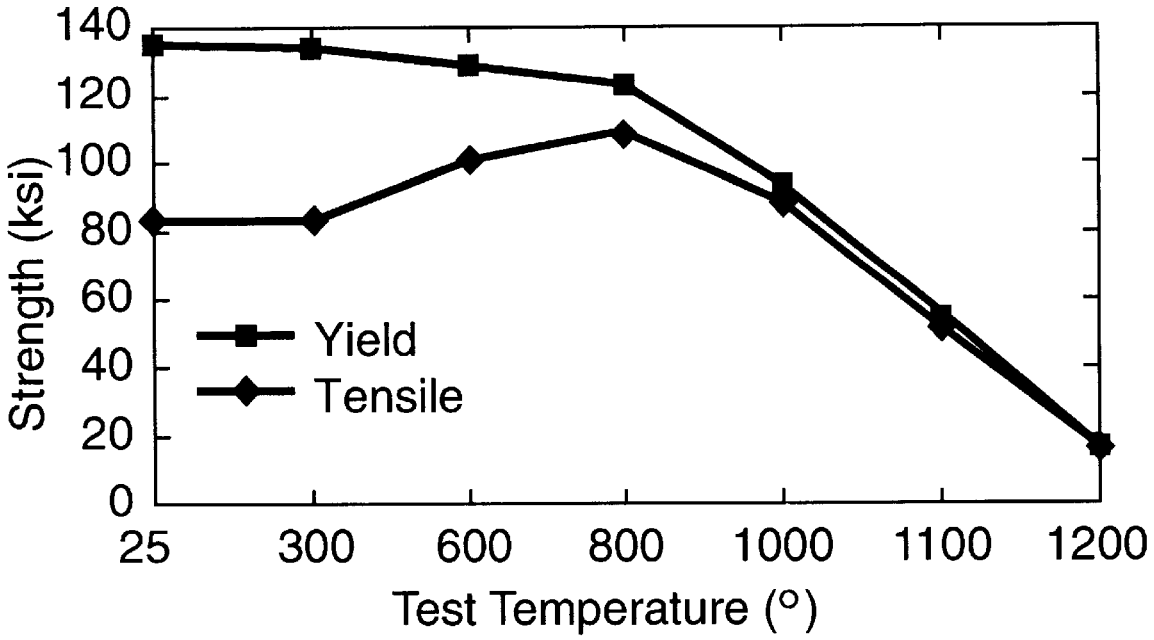
FIG. 1 is a graph showing yield and tensile strengths at various temperatures of alloys in accordance with the present invention.

For a better understanding of the present invention, together with other and further objects, advantages and capabilities thereof, reference is made to the following disclosure and appended claims in connection with the above-described drawings.

DETAILED DESCRIPTION OF THE INVENTION

The alloys of the present invention differ in composition from those described in the above referenced U.S. patent by the following modifications:

1) The Zr and Cr concentrations have been substantially lowered, and

2) The Mo concentration has been sharply increased.

The rationale for these modifications springs from the consideration that the excess amount of Zr might be responsible for promoting the formation of Zr-rich low-melting phases, and that Mo might be a more effective in strengthening than Cr. However, it is possible that the change in alloy composition may result in compromising other properties, such as high melting point and oxidation resistance at elevated temperatures. Thus, a careful selection of alloy composition via experimentation is required in order to develop an alloy with balanced properties suitable for structural use at temperatures well above 1000° C.

EXAMPLE I

Various $NB_3Al$-based alloy compositions in accordance with the present invention were prepared by conventional vacuum induction melting and casting methods using graphite molds. Specimens in the form of slab-shaped ingots weighing about 15 lb. and having dimensions of about 1.25×5×6 in. were formed. All the alloys were successfully cast into ingots without any difficulty. The alloys were characterized as having compositions which are listed in Table 1. All compositions are given in at.%.

TABLE I

| Alloy | Ni | Al | Mo | Cr | Zr | B | IMP (C °) |
|---|---|---|---|---|---|---|---|
| IC-435 | Balance | 16.37 | 8.27 | 0 | 0 | 0.15 | 1260 |
| IC-436 | Balance | 16.30 | 8.30 | 0 | 0.1 | 0.15 | 1240 |
| IC-437 | Balance | 16.50 | 4 | 6 | 0 | 0.15 | 1290 |
| IC-438 | Balance | 16.45 | 4 | 6 | 0.1 | 0.15 | 1350 |

The alloys of the present invention preferably contain ≦0.15 at.% of B for ductility improvement at ambient temperatures. Alloys IC-435 and IC-436 contain a high lever of Mo in order to promote solid solution hardening. For alloys IC-437 and 438, a portion of the Mo was replaced with Cr for possibly improving tensile ductility at intermediate temperatures. Zirconium at a level of 0.1% was added to alloys IC-436 and IC-438 for possibly improving creep properties and oxidation resistance at elevated temperatures.

The melting point of the alloys were determined by differential thermal analyses; results are shown in Table 1.

The alloys have a melting point above 1200° C.; IC-438 unexpectedly has the highest melting point, which was measured to be 1350° C. With such a high melting point, the alloy is capable of being used at temperatures close to 1300° C.

EXAMPLE II

Tensile specimens having dimensions of 0.125 in. gage diameter and 0.7 in. gage length were prepared by electro-discharge machining, followed by grinding. Tensile tests were performed thereon using an Instron testing machine in air at temperatures to 1100° C. and in vacuum at 1200° C. at a cross-head speed of 0.1-in per min. The results are summarized in Table II.

TABLE II

| Alloy No. | Yield Strength (ksi) | Ultimate Tensile Strength (ksi) | Elongation (%) |
|---|---|---|---|
| | Room Temperature | | |
| IC-435 | 97.0 | 148 | 12.3 |
| IC-436 | 98.5 | 168 | 18.6 |
| IC-437 | 78.0 | 124 | 26.3 |
| IC-438 | 82.9 | 235 | 20.8 |
| | 300° C. | | |
| IC-435 | — | — | — |
| IC-436 | 113 | 176 | 14.7 |
| IC-437 | — | — | — |
| IC-438 | 83.4 | 133 | 24.6 |
| | 600° C. | | |
| IC-435 | 121 | 150 | 10.4 |
| IC-436 | 119 | 162 | 18.1 |
| IC-437 | 91.1 | 114 | 16.5 |
| IC-438 | 100 | 129 | 15.0 |
| | 800° C. | | |
| IC-435 | — | — | — |
| IC-436 | 118 | 136 | 5.2 |
| IC-437 | — | — | — |
| IC-438 | 108 | 122 | 4.8 |
| | 1000° C. | | |
| IC-435 | 86.6 | 91.8 | 10.2 |
| IC-436 | 84.1 | 91.5 | 12.4 |
| IC-437 | 87.1 | 88.6 | 1.0 |
| IC-438 | 90 | 93.7 | 5.5 |
| | 1100° C. | | |
| IC-435 | — | — | — |
| IC-436 | 61.2 | 64.6 | 3.7 |
| IC-437 | — | — | — |
| IC-438 | 53.7 | 55.3 | 2.2 |
| | 1200° C. | | |
| IC-435 | — | — | — |
| IC-436 | — | — | — |
| IC-437 | — | — | — |
| IC-438 | 18.4 | 18.9 | 1.0 |

Alloys IC-435 and IC-436 containing 8.3% Mo have a higher strength than that of alloys IC-437 and IC-438 containing 4% Mo and 6% Cr at temperatures to 800° C., but the Cr-containing alloys have a better ductility at ambient temperatures. At temperatures above 800° C., the strengths of all the alloys are comparable. It has been demonstrated that the strength of alloy IC-396 developed previously dropped to zero at 1200° C., but the strength of IC-438 with the high melting point maintains as high as 18.4 ksi at 1200° C.

Figure 2:
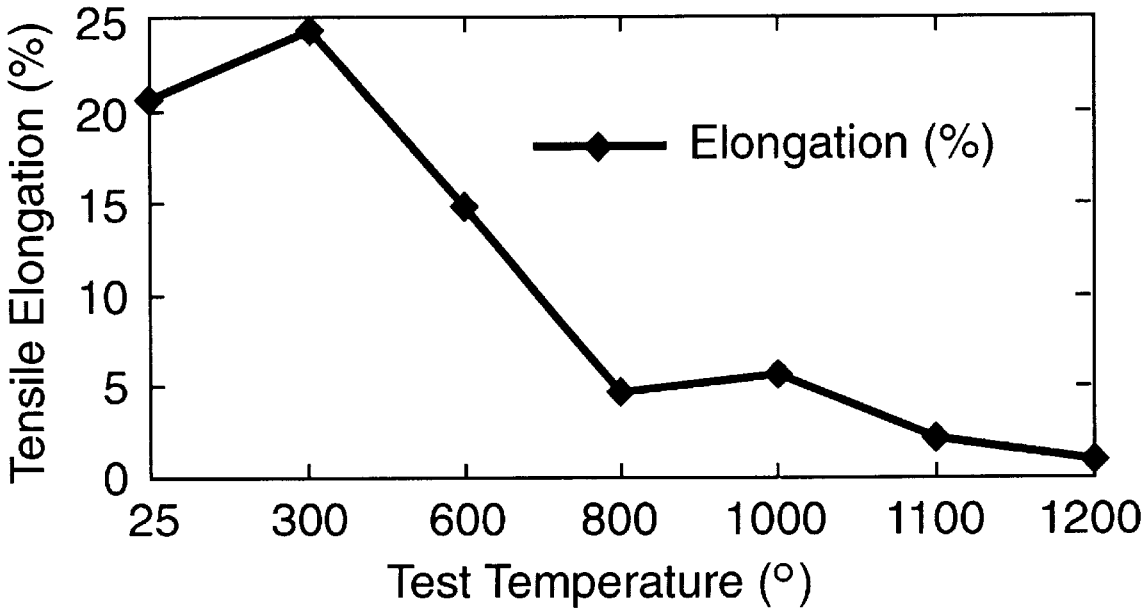
FIG. 2 is a graph showing tensile elongation at various temperatures of alloys in accordance with the present invention.

Tensile properties of IC-438 are plotted as a function of test temperature in FIGS. 1 and 2. The yield strength of the alloy shows an increase with temperature and reaches a maximum around 800° C. Above that temperature, the strength shows a decrease with temperature. Nevertheless, the alloy maintains a yield strength of 90 ksi at 1000° C. and 18.4 ksi at 1200° C. In comparison with the yield strength, the ultimate tensile strength of the alloy shows a general trend of decreasing with increasing temperature. The alloy exhibited a good tensile ductility at room temperature (20.8%) and 300° C. (24.6%). Above 300° C., the ductility shows a steady trend of decreasing with temperature. The low ductility of the alloys above 1000° C. may be related to the relatively high level of B (=0.15%) added to the alloy. It is expected that the high-temperature ductility of the IC alloys can be improved by reducing the B level to 0.05 at. %.

Figure 3:
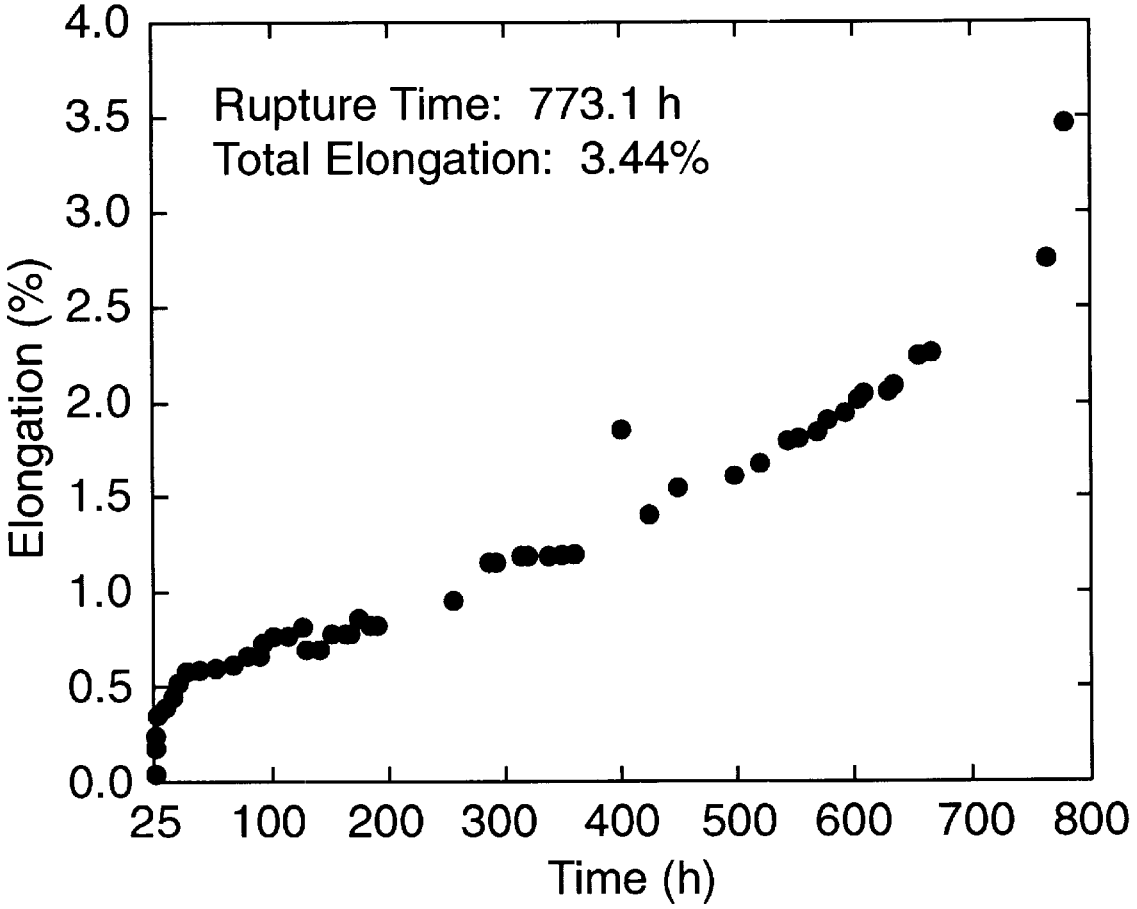
FIG. 3 is a graph showing elongation (creep) at various temperatures of alloys in accordance with the present invention.

Creep properties of the IC alloys were evaluated at different temperatures and stresses in air. FIG. 3 shows a creep curve typical of the IC alloys tested at 760° C. and 60 ksi. The three generally recognized stages of creep (primary, secondary, and tertiary) are all easily identified from the creep curve. From this curve, the rupture life, rupture ductility, and steady-state creep rate were measured. Table 3 summarizes the creep data of the IC alloys.

TABLE III

| Alloy | Creep Condition | | Steady-State Creep Rate | Rupture | |
|---|---|---|---|---|---|
| No. | Stress | Temp. (° C.) | (%/h) | Life (h) | Ductility (%) |
| IC-435 | 60 | 760 | $2.4 \times 10^{-3}$ | 754 | 3.4 |
| IC-436 | 60 | 760 | $2.0 \times 10^{-3}$ | >1253* | >5.6* |
| IC-438 | 60 | 760 | $1.9 \times 10^{-3}$ | >600* | >2.1* |
| IC-435 | 20 | 1040 | 1.6 | 5.0 | 4.3 |
| IC-436 | 20 | 1040 | 1.3 | 5.0 | 6.4 |
| IC-437 | 20 | 1040 | 1.1 | 0.5 | 2.3 |
| IC-438 | 20 | 1040 | 0.5 | 11.9 | 7.3 |

*Tests were stopped at the indicated time.

Figure 4:
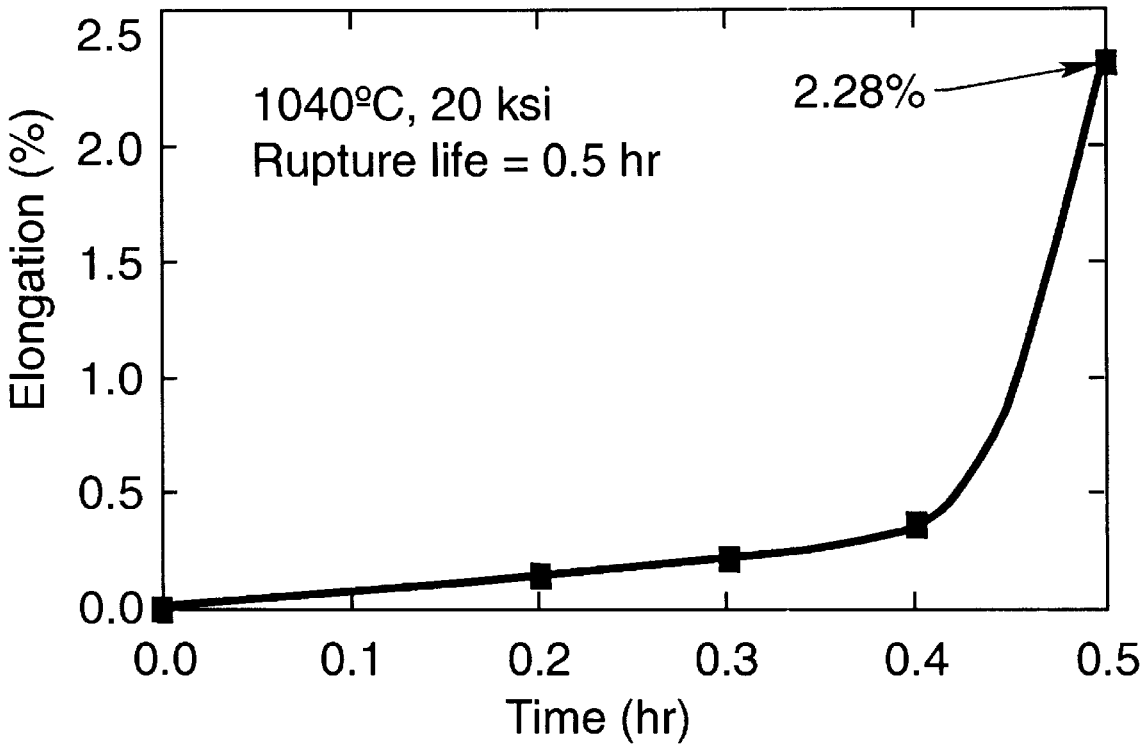
FIG. 4 is a graph showing elongation (creep) at various temperatures of alloys in accordance with the present invention.
Figure 5:
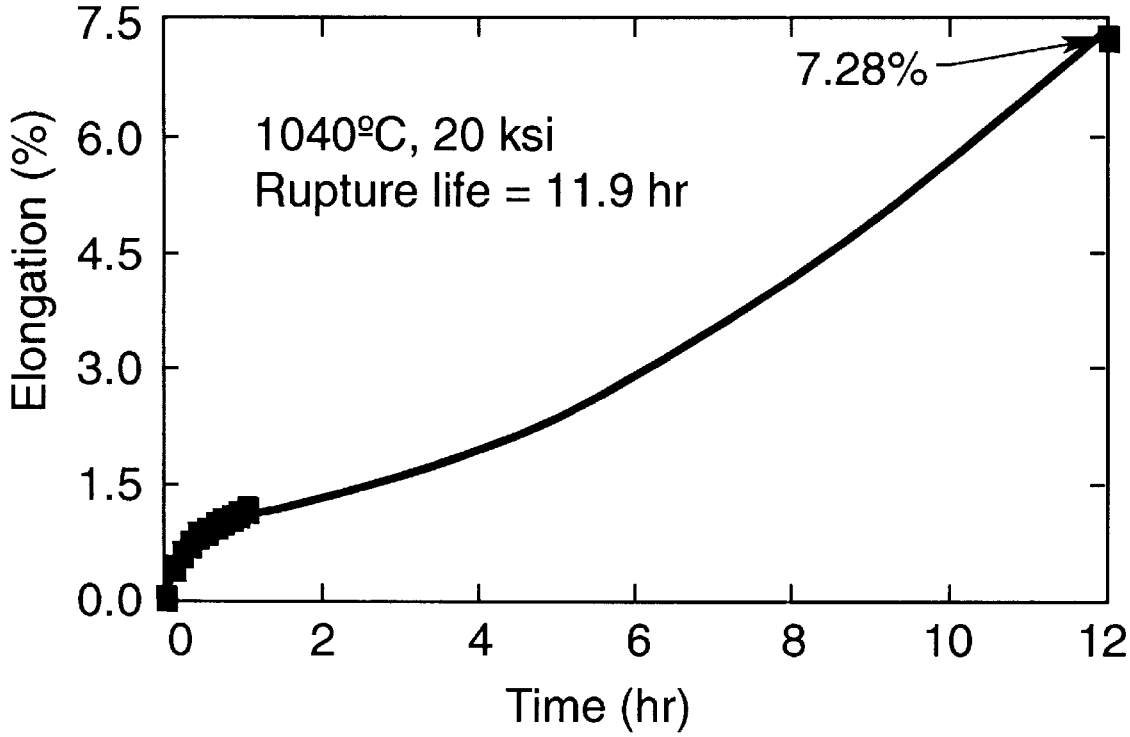
FIG. 5 is a graph showing elongation (creep) at various temperatures of alloys in accordance with the present invention.

At a temperature of 760° C. the steady-state creep rate of the alloys is roughly about the same. However, in terms of rupture life, the alloys containing 4% Mo and 6% Cr are much longer than that of IC-435 containing 8.3% Mo. FIGS. 4 and 5 show the effect of the Zr addition at a level of 0.1% on the creep of the IC-437 and IC-438 alloys, which contain Mo and Cr. The comparison indicates that alloying with 0.1% Zr extends the rupture life by a factor of as high as 24. Thus, Zr is very effective in improving the creep properties of the IC alloys containing both Mo and Cr.

The air oxidation properties of the IC alloys were determined at 1000° C., 1100° C., and 1200° C. in air. In this test, alloy coupons were periodically removed from the furnace for weight measurement and oxidation examination. The results of are these tests are summarized in Table 4.

TABLE IV

| | Oxidation Condition | | Time (h) for First | Wt. Change |
|---|---|---|---|---|
| Alloy No. | Temp (° C.) | Time (h) | Spalling | g/h/cm$^2$ |
| IC-435 | 1000 | 490 | * | $1.1 \times 10^{-6}$ |
| IC-436 | 1000 | 490 | * | $1.5 \times 10^{-6}$ |
| IC-437 | 1000 | 490 | * | $2.0 \times 10^{-7}$ |
| IC-438 | 1000 | 490 | * | $1.2 \times 10^{-6}$ |
| IC-435 | 1100 | 490 | 36 | $-4.1 \times 10^{-5}$ |
| IC-436 | 1100 | 490 | 36 | $-5.2 \times 10^{-5}$ |
| IC-437 | 1100 | 490 | 248 | $-2.6 \times 10^{-5}$ |

TABLE IV-continued

| Alloy No. | Oxidation Condition Temp (° C.) | Oxidation Condition Time (h) | Time (h) for First Spalling | Wt. Change g/h/cm$^2$ |
|---|---|---|---|---|
| IC-438 | 1100 | 490 | 248 | $-2.0 \times 10^{-5}$ |
| IC-435 | 1200 | 134 | 2 | $-1.4 \times 10^{-3}$ |
| IC-436 | 1200 | 134 | 2 | $-2.6 \times 10^{-3}$ |
| IC-437 | 1200 | 500 | 2 | $-1.9 \times 10^{-4}$ |
| IC-438 | 1200 | 500 | 2 | $-2.6 \times 10^{-4}$ |

*No apparent spalling.

At 1000° C., no apparent spalling was observed for all the alloys. The alloys showed essentially the same oxidation rate for IC-435, IC-436 and IC-438, except for IC-437 whose oxidation rate is lower at 1000° C. At 1100° C., IC-435 and IC-436 containing 8.3% Mo exhibited spalling around 36 h while alloys IC-437 and IC-438 containing both Mo and Cr started to spall around 248 h. In terms of the oxidation rate at 1100° C., IC-437 and 438 have a lower rate by a factor of 2. At 1200° C., the oxidation rate of IC-437 and IC-438 is lower by an order of magnitude as compared with IC-435 and IC-436.

The above analyses of the new IC alloys leads to the conclusion that IC-438, with its melting point as high as 1350° C., has preferred mechanical and metallurgical properties for structural applications at temperatures well above 1000° C.

While there has been shown and described what are at present considered the preferred embodiments of the invention, it will be obvious to those skilled in the art that various changes and modifications can be made therein without departing from the scope of the inventions defined by the appended claims.

What is claimed is:

1. An intermetallic alloy consisting essentially of, in atomic %: 15.5% to 17.0% Al, 3.5% to 5.5% Mo, 4% to 8% Cr, 0.04% to 0.2% Zr, 0.04% to 1.5% B, balance Ni, said alloy characterized by a yield strength of at least 18.4 ksi at a temperature of 1200° C.

2. An intermetallic alloy in accordance with claim 1 further consisting essentially of, in atomic %: 16.3% to 16.5% Al, 3.5% to 5.5% Mo, 4% to 8% Cr, 0.04% to 0.15% Zr, 0.04% to 1.5% B, balance Ni, said alloy characterized by a yield strength of at least 18.4 ksi at a temperature of 1200° C.

3. An intermetallic alloy consisting essentially of, in atomic %: 16.45% Al, 4% Mo, 6% Cr, 0.1% Zr, 0.15% B, balance Ni, said alloy characterized by a yield strength of at least 18.4 ksi at a temperature of 1200° C.

* * * * *